US009925822B2

(12) United States Patent
Chiu

(10) Patent No.: US 9,925,822 B2
(45) Date of Patent: Mar. 27, 2018

(54) PEN TRACK

(71) Applicant: Yung-Peng Chiu, Taichung (TW)

(72) Inventor: Yung-Peng Chiu, Taichung (TW)

( * ) Notice: Subject to any disclaimer, the term of this patent is extended or adjusted under 35 U.S.C. 154(b) by 93 days.

(21) Appl. No.: 14/722,517

(22) Filed: May 27, 2015

(65) Prior Publication Data

US 2016/0347110 A1 Dec. 1, 2016

(51) Int. Cl.

| | |
|---|---|
| ***B43K 29/00*** | (2006.01) |
| ***B43K 23/00*** | (2006.01) |
| ***B43L 11/00*** | (2006.01) |

(52) U.S. Cl.

CPC ..... *B43K 23/001* (2013.01); *B43K 29/00* (2013.01); *B43L 11/00* (2013.01)

(58) Field of Classification Search

CPC ..... B43K 23/001; B43K 29/00; B43K 24/00; B43K 24/06; B43K 24/14; B43K 24/146; B43K 29/001; B43K 29/002; B43K 29/08; B43K 29/20

See application file for complete search history.

(56) References Cited

U.S. PATENT DOCUMENTS

| | | | | |
|---|---|---|---|---|
| 2,832,140 A | | 4/1958 | Gaines | |
| 3,638,319 A | | 2/1972 | Barlow et al. | |
| 3,848,564 A | * | 11/1974 | Kull | B44D 3/00 101/114 |
| 4,756,086 A | | 7/1988 | Yajima et al. | |
| 6,264,388 B1 | * | 7/2001 | Wang | B43K 24/06 401/109 |
| 6,536,973 B2 | * | 3/2003 | DeLuca | B43K 24/02 401/109 |

FOREIGN PATENT DOCUMENTS

| | | |
|---|---|---|
| JP | 52-29242 | 8/1975 |
| JP | 57-47698 | 3/1982 |
| JP | H09-24164 | 1/1997 |

* cited by examiner

*Primary Examiner* — David Walczak

(74) *Attorney, Agent, or Firm* — Ming Chow; Sinorica, LLC

(57) ABSTRACT

A pen track has an outer shell, a transmitting group, a rotating group, and a linking group. The transmitting group is mounted in the outer shell and has a portion rotatably abutting a drawing surface. The rotating group is mounted in the outer shell and has a modeling block. The modeling block is mounted in the outer shell, is rotated with the transmitting group, and has an outer surface and a modeling segment annularly formed on the outer surface of the modeling block and having multiple curved surfaces connecting each other. The linking group is mounted in the outer shell and has a pushing protrusion pressed against the modeling segment of the modeling block to move the linking group reciprocally relative to the outer shell along the curved surfaces of the modeling segment.

17 Claims, 8 Drawing Sheets

PEN TRACK

BACKGROUND OF THE INVENTION

1. Field of the Invention

The present invention relates to a drawing instrument, and more particularly to a pen track that can draw undulating lines regularly without using auxiliary tools.

2. Description of Related Art

When users paint posters by hands or making cards, users may draw undulating lines. In a conventional drawing method, the users need to prepare an auxiliary tool such as a ruler, a french curve or a curve plate to enable a pen to abut a contour of the auxiliary tool to draw lines. However, the users need to prepare the auxiliary tool in advance, and the auxiliary tool may be slid when the users apply an excessive force to abut the auxiliary tool. Then, the lines cannot be drawn according to the contour of the auxiliary tool. Furthermore, the auxiliary tool has a limited length, and the users need to constantly move the auxiliary tool to extend the length of line. This is inconvenient in use and a gap may be generated at the convergence of lines. Additionally, the auxiliary tool usually has a specific contour, and the users need to prepare multiple auxiliary tools of different contours when the users want to draw undulating lines of different types. In view of the above-mentioned problems, the conventional drawing method is inconvenient in use and is prone to drawing errors when the users want to draw undulating lines.

To overcome the shortcomings, the present invention tends to provide a pen track to mitigate the aforementioned problems.

SUMMARY OF THE INVENTION

The main objective of the invention is to provide a pen track that can reduce frictions for positioning mounts of the pen track that can draw undulating lines regularly without using auxiliary tools.

A pen track in accordance with the present invention has an outer shell, a transmitting group, a rotating group, and a linking group. The transmitting group is mounted in the outer shell and has a portion rotatably abutting a drawing surface. The rotating group is mounted in the outer shell and has a modeling block. The modeling block is mounted in the outer shell, is rotated with the transmitting group, and has an outer surface and a modeling segment annularly formed on the outer surface of the modeling block and having multiple curved surfaces connecting each other. The linking group is mounted in the outer shell and has a pushing protrusion pressed against the modeling segment of the modeling block to move the linking group reciprocally relative to the outer shell along the curved surfaces of the modeling segment.

Other objects, advantages and novel features of the invention will become more apparent from the following detailed description when taken in conjunction with the accompanying drawings.

DETAILED DESCRIPTION OF PREFERRED EMBODIMENT

Figure 1:
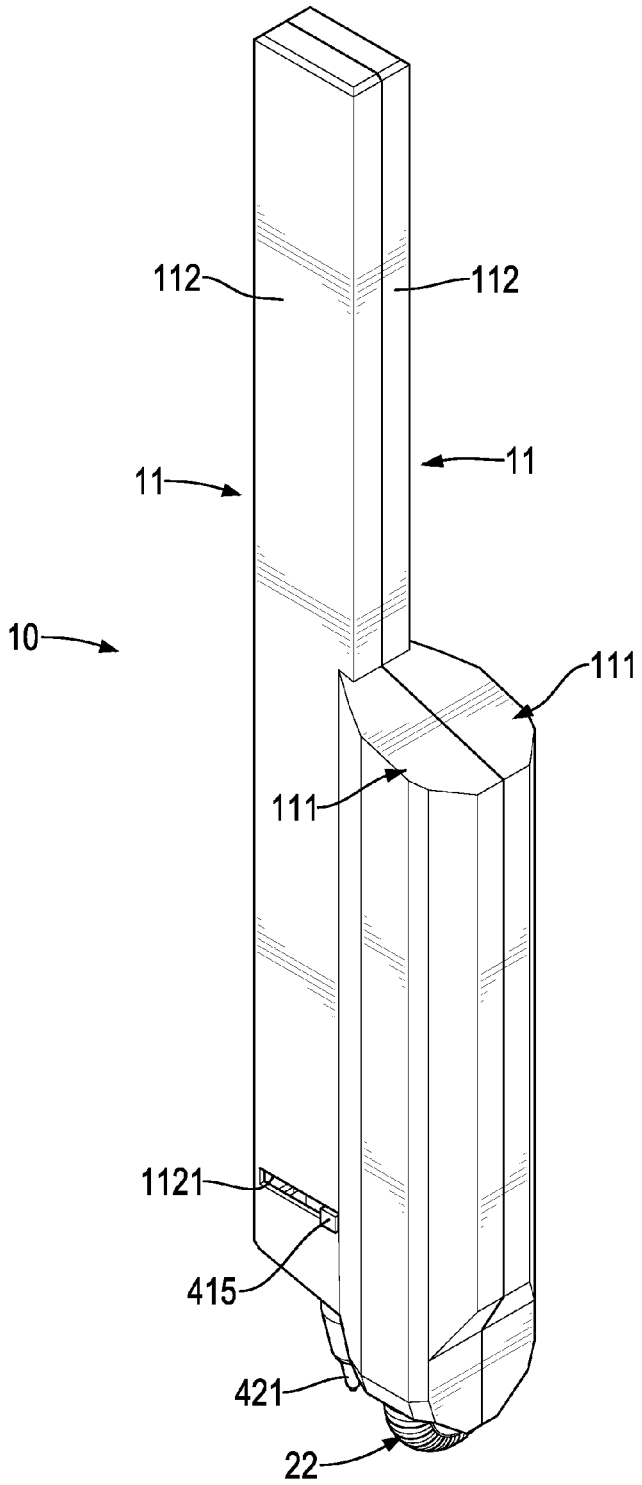
FIG. 1 is a perspective view of a first embodiment of a pen track in accordance with the present invention.
Figure 2A:
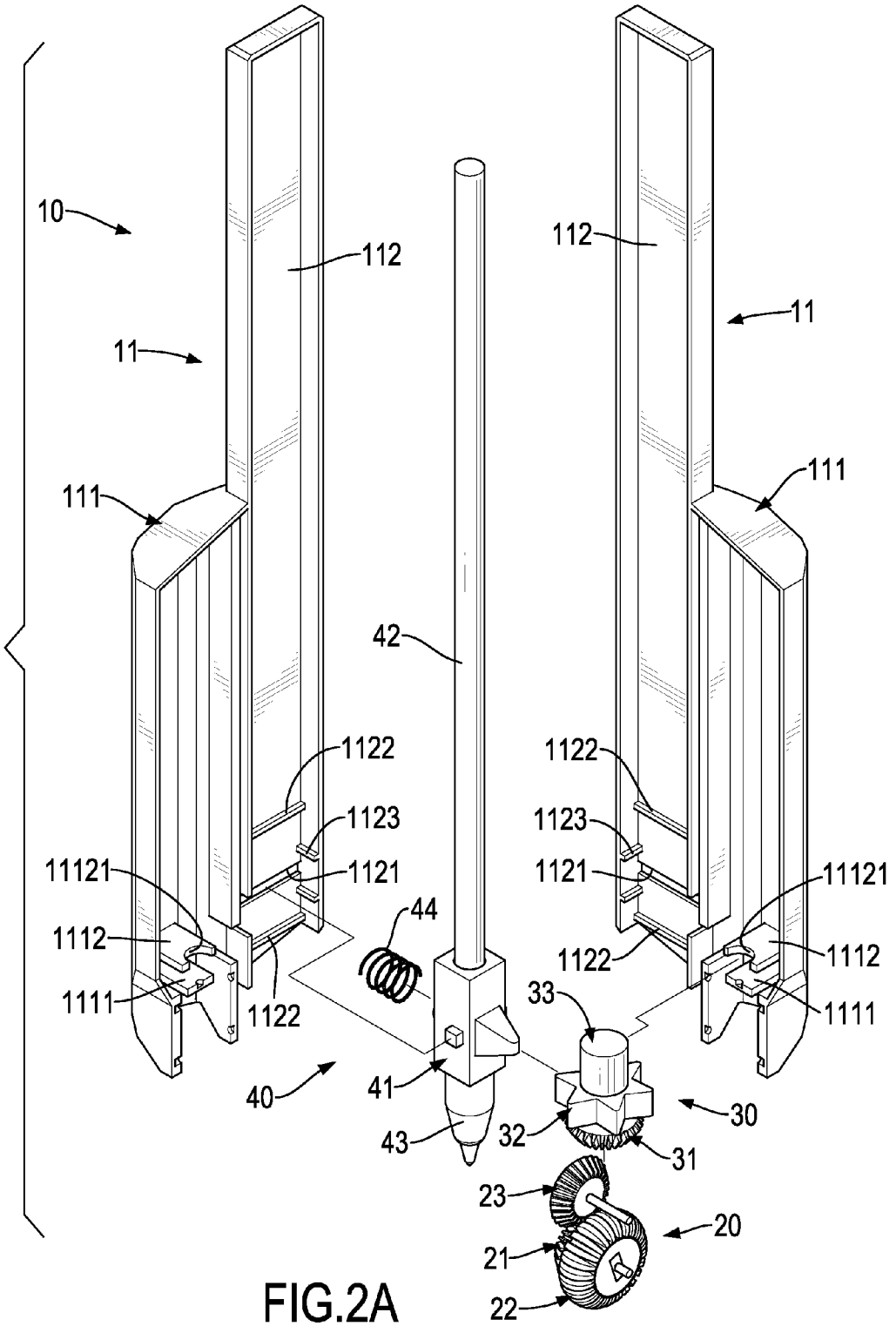
FIG. 2A is an exploded perspective view of the pen track in FIG. 1.

With reference to FIGS. 1 and 2A, a first embodiment of a pen track in accordance with the present invention comprises an outer shell 10, a transmitting group 20, a rotating group 30, and a linking group 40.

The outer shell 10 has a driving space and a pen chamber and may be composed by two half-casings 11. The half-casings 11 are connected to each other, and each one of the half-casings 11 has a first mounting segment 111 and a second mounting segment 112. The first mounting segment 111 is a cover and has a closed top, an open bottom, a linking panel, two side boards, a mounting panel 1111 and a limiting panel 1112. The linking panel is formed with the closed top of the first mounting segment 111 and has two opposite edges and an inner side. The side boards are formed with the closed top of the first mounting segment 111, are respectively formed with the opposite edges of the linking panel, and face to each other.

Each side board has a bottom end, a lower mounting hole and an upper mounting hole. The open bottom of the first mounting segment 111 is formed between the linking panel and the bottom ends of the side boards. The lower mounting hole may be semicircular, is formed in the side board near the bottom end of the side board, and aligns with the lower mounting hole of the other side board. The upper mounting hole may be semicircular, is formed in the side board above the lower mounting hole, and aligns with the upper mounting hole of the other side board.

In addition, when the half-casings 11 are connected to each other, the side boards of one of the half-casings 11 respectively abut the side boards of the other half-casing 11. Then, the lower mounting hole of each side board of one of the half-casings 11 aligns with the lower mounting hole of a corresponding side board of the other half-casing 11 to form a circular lower mounting hole. Furthermore, the upper mounting hole of each side board of one of the half-casings 11 aligns with the upper mounting hole of a corresponding side board of the other half-casing 11 to form a circular upper mounting hole.

The mounting panel 1111 is transversally formed on and protrudes from the inner side of the linking panel between the side boards and has a free end, a top face, and an engaging hole. The free end of the mounting panel 1111 is opposite to the inner side of the linking panel and extends between the side boards. The engaging hole may be semicircular and is formed in the top face of the mounting panel 1111 at the free end of the mounting panel 1111. The limiting panel 1112 is transversally formed on and protrudes from the inner side of the linking panel above the mounting panel 1111 and has a free end, a top face, a bottom face, and a limiting mouth 11121. The free end of the limiting panel 1112 is opposite to the inner side of the linking panel and extends between the side boards. The limiting mouth 11121 may be semicircular and is formed through the top face and the bottom face of the limiting panel 1112 at the free end of the limiting panel 1112. When the half-casings 11 are connected to each other, the limiting mouths 11121 of the limiting panels 1112 are formed as a circular limiting hole.

The second mounting segment 112 is a rectangular cover, is formed with one of the side boards of the first mounting segment 111, and is longer than the first mounting segment 111. The second mounting segment 112 has a closed top, an open bottom, a linking panel, two side boards, a guiding hole 1121, two guiding ribs 1122 and two holding blocks 1123. The linking panel is formed with the closed top of the second mounting segment 112 and has two opposite edges and an inner side. The side boards are formed with the closed top of the second mounting segment 112, are respectively formed with the opposite edges of the linking panel, and face to each other. Each side board has a bottom end. The open bottom of the second mounting segment 112 is formed between the linking panel and the bottom ends of the side boards.

The guiding hole 1121 is rectangular, and is transversally formed through the inner side of the linking panel of the second mounting segment 112 between the side boards of the second segment 112. Furthermore, the position of the guiding hole 1121 is higher than the position of the limiting panel 1112 of the first mounting segment 111. The guiding ribs 1222 are transversally formed on and protrude from the inner side of the linking panel of the second mounting segment 112 beside the guiding hole 1121 and are connected to the side boards of the second mounting segment 112. The holding blocks 1123 are formed on and protrude from an inner face of the side board of the second mounting segment 112 that is opposite to the first mounting segment 111 beside the guiding hole 1121 and between the guiding ribs 1122.

When the half-casings 11 are connected to each other, the driving space of the outer shell 10 is formed between the first mounting segments 111, and the pen chamber is formed between the second mounting segments 112 of the half-casings 11 and communicates with the driving space. In addition, a guiding groove is formed between the guiding ribs 1122 when the half-casings 11 are connected to each other. Preferably, one of the half-casings 11 has multiple connecting rods, and the other half-casing 11 has multiple connecting holes respectively connecting to the connecting rods to connect the half-casings 11 with each other.

Figure 2B:
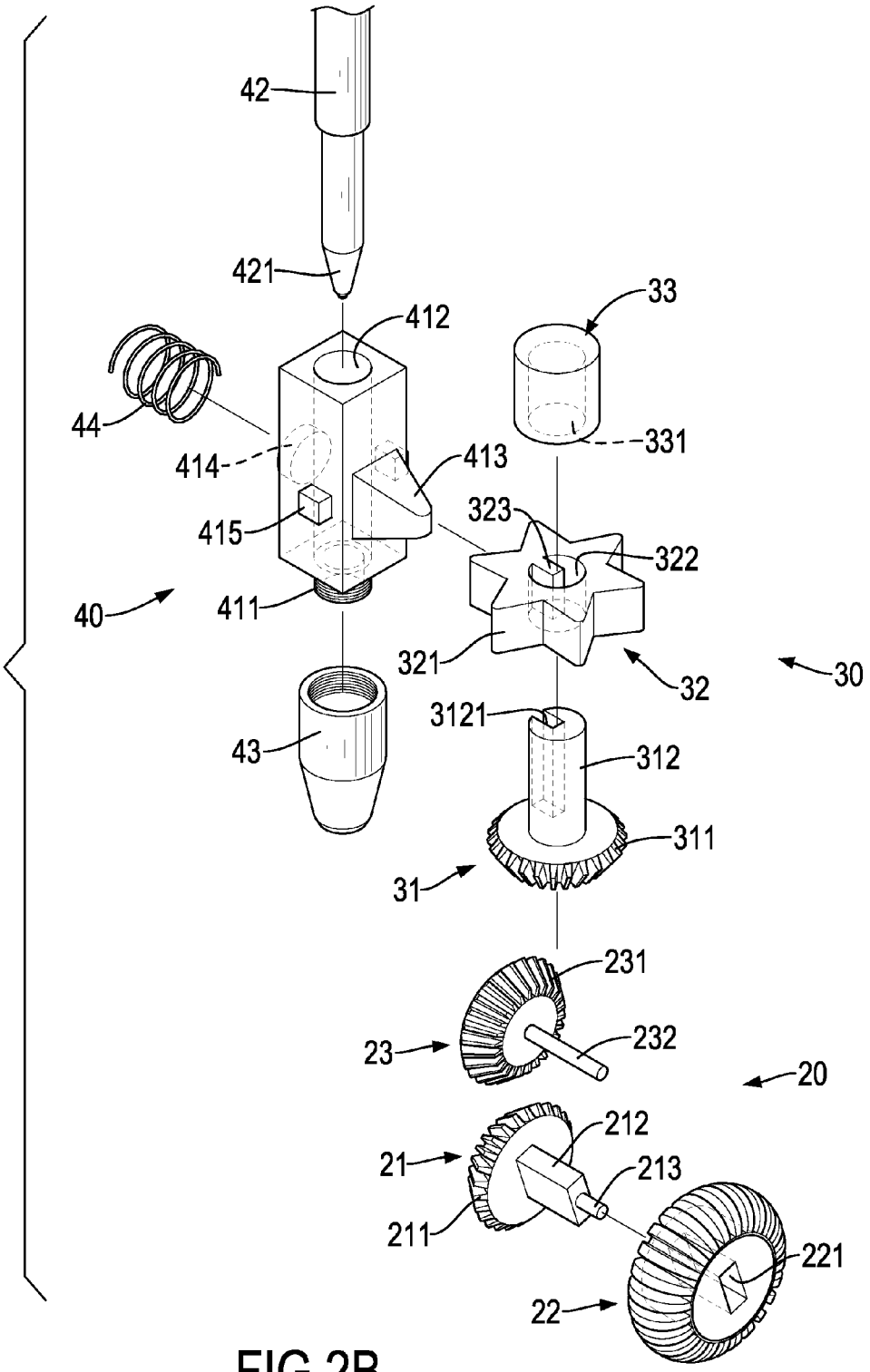
FIG. 2B is a further exploded perspective view of the pen track in FIG. 2A.
Figure 3:
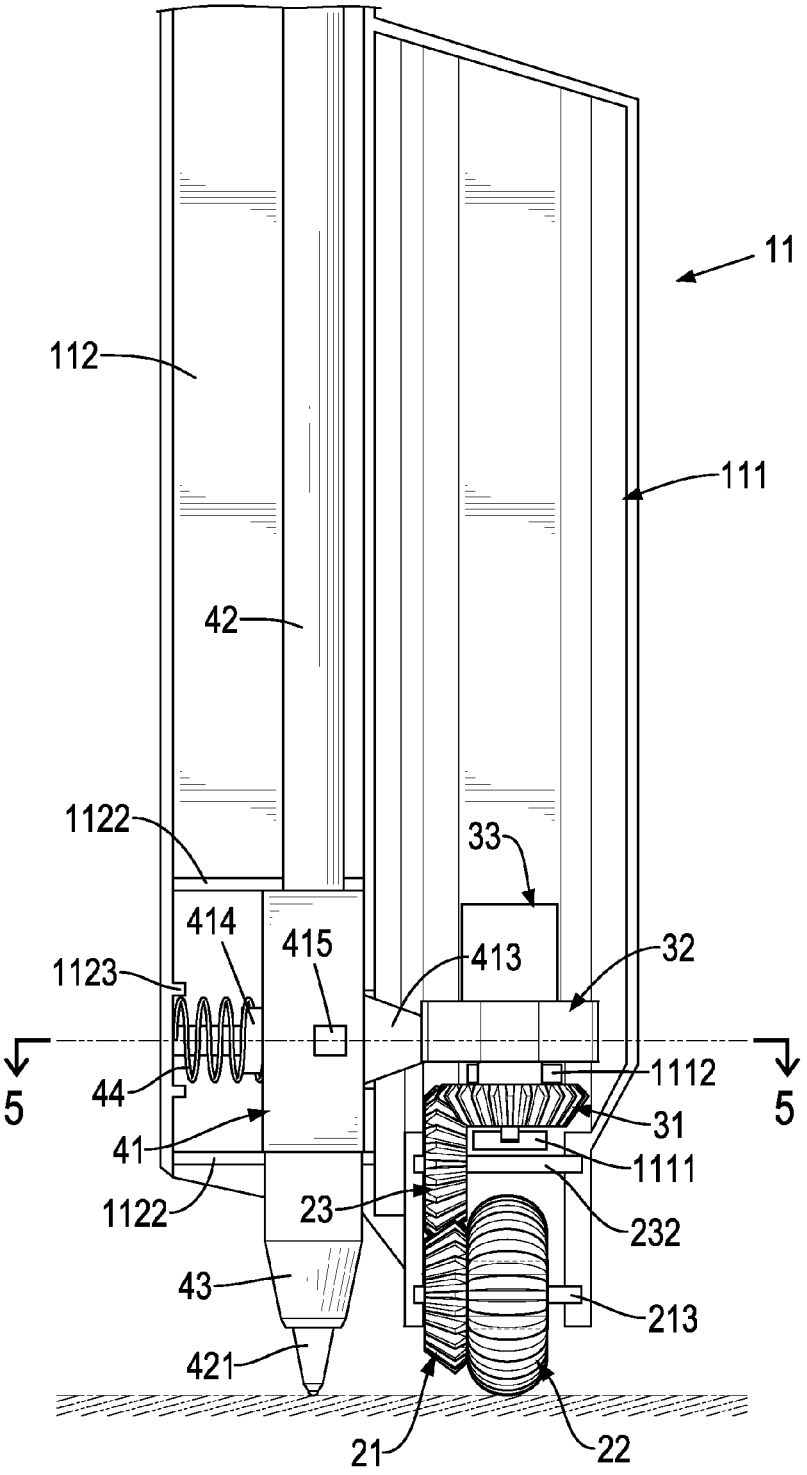
FIG. 3 is an enlarged side view in partial section of the pen track in FIG. 1.

With reference to FIGS. 2A, 2B and 3, the transmitting group 20 is mounted in the outer shell 10 and has a transmitting element 21, a rotating wheel 22, and a linking element 23.

The transmitting element 21 is connected to the first mounting segments 111 of the half-casings 11, extends out of the open bottoms of the first mounting segments 111, and has a bevel gear 211, a fixing block 212, and two pivot rods 213. The bevel gear 211 is rotatably connected to the first mounting segments 111 and has an inner side, an outer side, an annular surface, and multiple teeth. The teeth are formed around the annular surface of the bevel gear 211 between the inner side and the outer side of the bevel gear 211. The fixing block 212 may be rectangular and is formed on and protrudes from the inner side of the bevel gear 211 and has a free edge opposite to the bevel gear 211. The pivot rods 213 are respectively formed on and protrude from the outer side of the bevel gear 211 and the free edge of the fixing block 212, align with each other, and are rotatably mounted in the lower mounting holes of the first mounting segments 111.

The rotating wheel 22 is connected to the transmitting element 21, extends out of the open bottoms of the first mounting segments 111, and has a center and a fixing hole 221. The fixing hole 221 is formed through the center of the rotating wheel 22, is disposed around the fixing block 212, and has a shape corresponding to a shape of the fixing block 212. In addition, the pivot rod 213 that is formed on the free edge of the fixing block 212 extends out of the rotating wheel 22 via the fixing hole 221.

The linking element 23 is rotatably mounted in the first mounting segments 111, engages with the transmitting element 21, and has a bevel gear 231 and a rotating shaft 232. The bevel gear 231 is rotatably mounted in the first mounting segments 111 above the transmitting element 21, engages with the bevel gear 211 of the transmitting element 21, and has two opposite sides. The rotating shaft 232 is connected to the bevel gear 231 of the linking element 23 and has two pivot ends. The pivot ends of the rotating shaft 232 respectively extend out of the opposite sides of the bevel gear 231 of the linking element 23 and are rotatably mounted in the upper mounting holes of the first mounting segments 111.

With further reference to FIG. 2B, the rotating group 30 is mounted in the outer shell 10, is rotatably connected to the transmitting group 20, and has a rotating element 31, a modeling block 32, and a holding cap 33.

With reference to FIGS. 2A and 3, the rotating element 31 is rotatably mounted in the first mounting segments 111 above the rotating wheel 22, engages with the bevel gear 231 of the linking element 23, and has a bevel gear 311 and a mounting rod 312. The bevel gear 311 is mounted in the first mounting segments 111 between the mounting panels 1111 and the limiting panels 1112, engages with the bevel gear 231 of the linking element 23, and has a top side, a bottom side, and an inserting rod. The inserting rod is formed on and protrudes from the bottom side of the bevel gear 311 and is mounted in the engaging holes of the mounting panels 1111.

The mounting rod 312 is formed on and protrudes from the top side of the bevel gear 311 of the rotating element 31, extends out of the limiting panels 1112 via the limiting mouths 11121, and has a mounting end, an outer surface, and an embedded groove 3121. The mounting end of the mounting rod 312 extends upwardly out of the limiting panels 1112 via the limiting mouths 11121. The embedded groove 3121 may be rectangular and is axially formed through the mounting end and the outer surface of the mounting rod 312.

The modeling block 32 is rotatably mounted in the first mounting segments 111, is securely mounted on the rotating element 31, and has a center, an outer surface, a modeling segment 321, a through hole 322, and an embedded protrusion 323. The modeling segment 321 is annularly formed on the outer surface of the modeling block 32 and has multiple curved surfaces. Preferably, a cross section of the modeling segment 321 may be a hexagram, and the cross section of the modeling segment 321 can also be in other shapes. The through hole 322 is formed through the center of the modeling block 32, is disposed around the mounting rod 312 of the rotating element 31, and has an inner surface. The embedded protrusion 323 may be rectangular, is formed on and inwardly protrudes from the inner surface of the through hole 322, and is securely mounted in the embedded groove 3121 to hold the modeling block 32 securely with the rotating element 31.

The holding cap 33 is mounted on the rotating element 31 above the modeling block 32 and has a bottom side and a holding hole 331. The holding hole 331 is formed through the bottom side of the holding cap 33 and is disposed around the mounting end of the mounting rod 312 of the rotating element 31.

With reference to FIGS. 2A and 2B, the linking group 40 is mounted in the outer shell 10, is pressed against the rotating group 30, and has a holding mount 41, a refill 42, a protecting sheath 43, and a spring 44.

The holding mount 41 may be a rectangular block, is slidably mounted in the second mounting segments 112 between the guiding ribs 1122, and has an upper end, a lower end, four sides, a connecting segment 411, a refill hole 412, a pushing protrusion 413, a mounting base 414, and two sliding blocks 415. The connecting segment 411 is a hollow cylinder, is formed on and protrudes downwardly from the lower end of the holding mount 41, and has an external surface and a thread. The thread is formed around the external surface of the connecting segment 411. The refill hole 412 is formed through the upper end and the lower end of the holding mount 41 and communicates with the connecting segment 411.

The pushing protrusion 413 may be pyramidal, is formed on and protrudes from one of the four sides of the holding mount 41, and is pressed against one of the curved surfaces of the modeling segment 321 of the modeling block 32. The mounting base 414 may be round, and is formed on and protrudes from one of the sides of the holding mount 41 that is opposite to the pushing protrusion 413. The sliding blocks 415 are respectively formed on and protrude from the other two sides of the holding mount 41 between the pushing protrusion 413 and the mounting base 414. With further reference to FIG. 1, the sliding blocks 415 are respectively and slidably mounted in the guiding holes 1121 of the second mounting segments 112 and respectively extend out of the second mounting segments 112.

The refill 42 is mounted in the second mounting segments 112, is mounted through the holding mount 41 via the through hole 412 and the connecting segment 411, and extends out of the open bottoms of the second mounting segments 112. The refill 42 has a lower end and a drawing segment 421. The lower end of the refill 42 extends out of the open bottoms of the second mounting segments 112. The drawing segment 421 is mounted on the lower end of the refill 42 and has a same height level relative to the rotating wheel 22.

The protecting sheath 43 is hollow, is connected to the holding mount 41, and is mounted around the lower end of the refill 42. The protecting sheath 43 has an open top, an open bottom, and an inner thread. The inner thread is formed in the protecting sheath 43 near the open top of the protecting sheath 43 and is screwed with the thread of the connecting segment 411 of the holding mount 41. The drawing segment 421 extends out of the second mounting segments 112 via the open bottom of the protecting sheath 43. The spring 44 is held in the second mounting segments 112 between the holding blocks 1123, and is mounted around the mounting base 414 of the holding mount 41 to push the pushing protrusion 413 to press against the modeling block 32.

With reference to FIGS. 2A, 2B and 3, for assembling the linking group 40, the protecting sheath 43 is connected to the connecting segment 411 of the holding mount 41, and the drawing segment 421 of the refill 42 is inserted into the refill hole 412 and extends out of the protecting sheath 43. The spring 44 is mounted in the second mounting segments 122 between the holding blocks. The holding mount 41 and the protecting sheath 43 are mounted in the second mounting segments 112 of the half-casings 11 with the refill 42 for mounting the spring 44 around the mounting base 414. In addition, the holding mount 41 is held in the second mounting segments 112 between the guiding ribs 1122, and the pushing protrusion 413 is pressed against the modeling segment 321 of the modeling block 32 by an elastic force of the spring 44.

Figure 4:
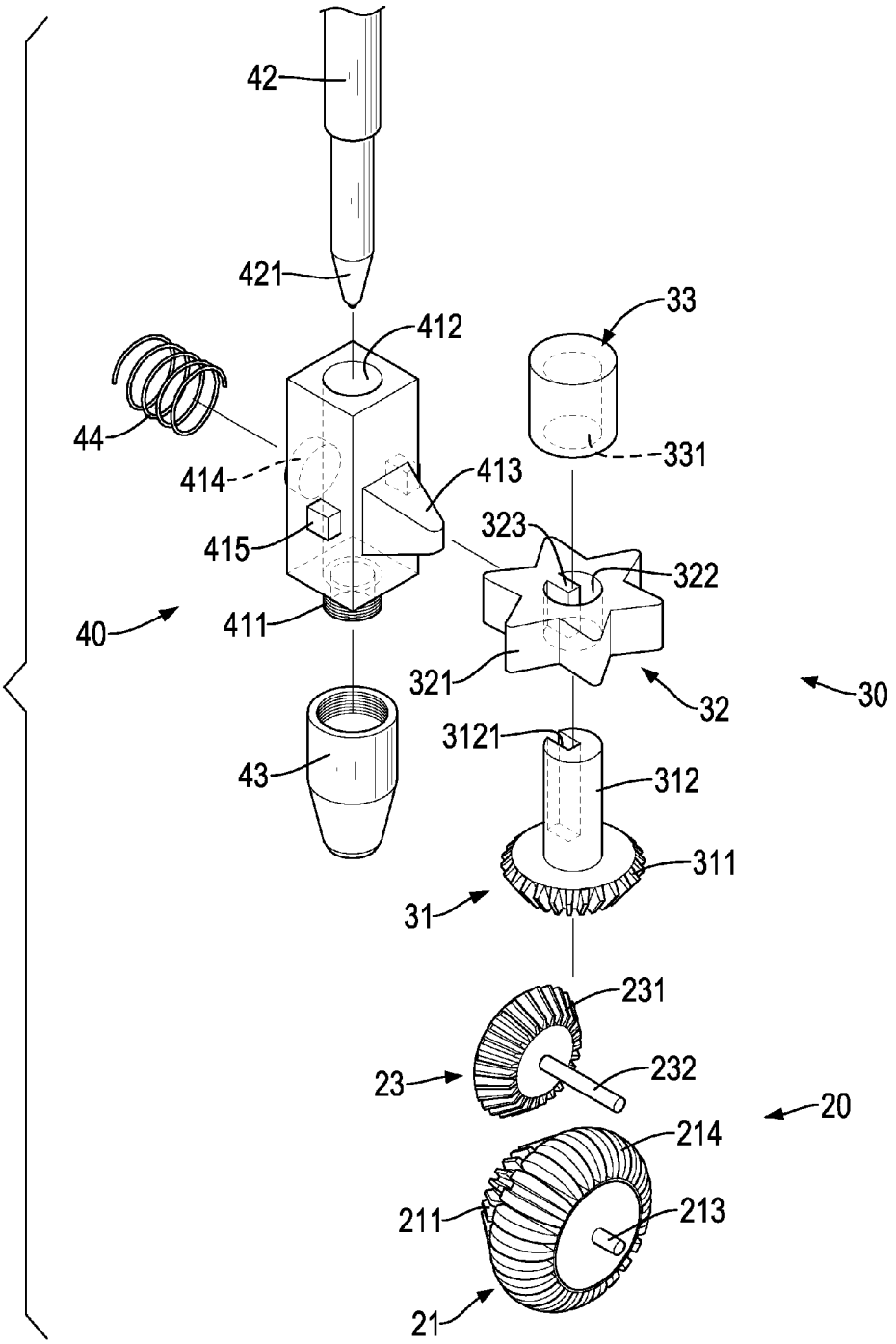
FIG. 4 is an exploded perspective view of a second embodiment of a pen track in accordance with the present invention.

With reference to FIG. 4, a second embodiment of a pen track in accordance with the present invention is substantially the same as the first embodiment except for the following features. The pen track has an outer shell 10, a transmitting group 20, a rotating group 30, and a linking group 40. The transmitting element 21 of the transmitting group 20 has a bevel gear 211, two pivot rods 213 and a rotating wheel 214. The rotating wheel 214 is formed with the bevel gear 211 as a single piece, and the pivot rods 213 are respectively formed on and protrude from the bevel gear 211 and the rotating wheel 214 and align with each other.

Figure 5:
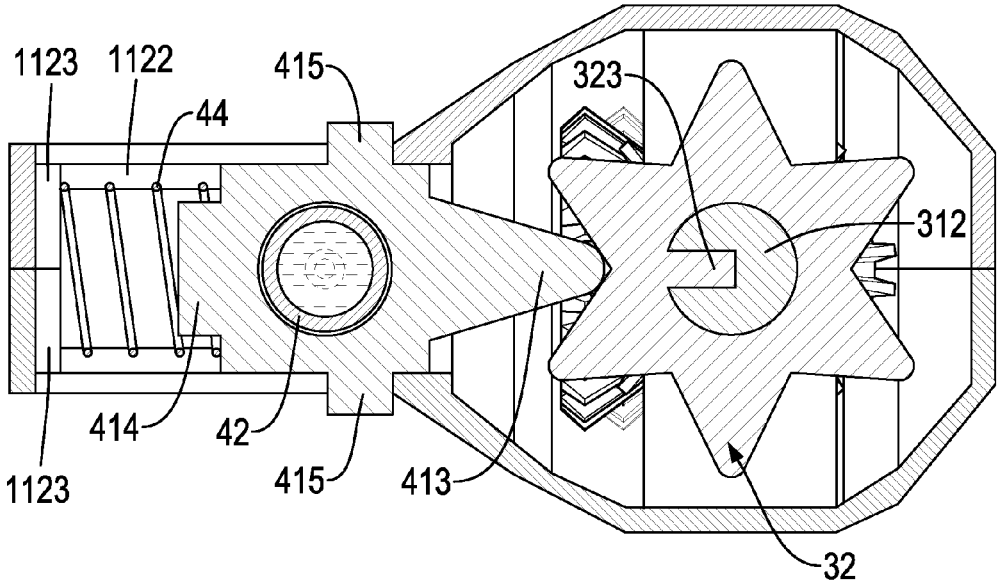
FIG. 5 is an enlarged top view of the pen track along line 5-5 in FIG. 3.
Figure 6:
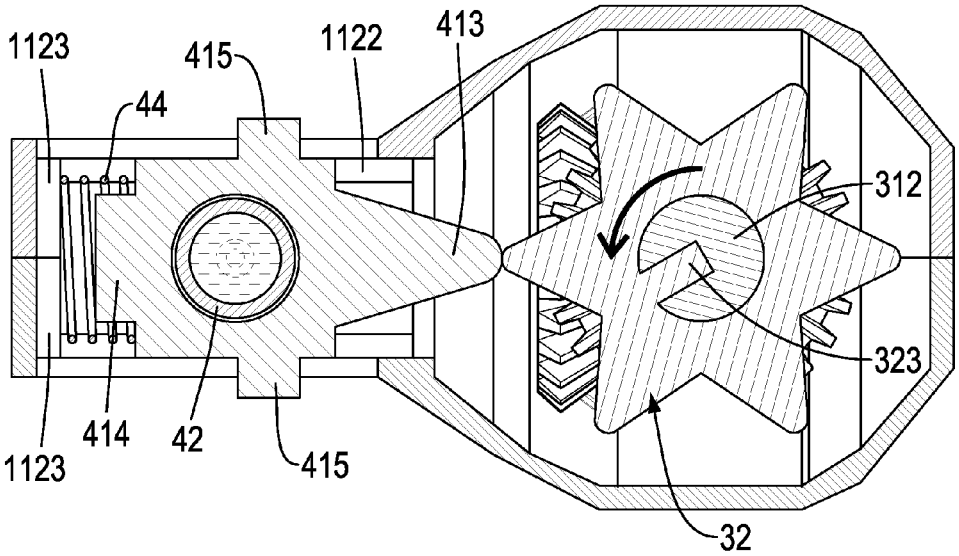
FIG. 6 is another enlarged and operational top view of the pen track in FIG. 1.
Figure 7:
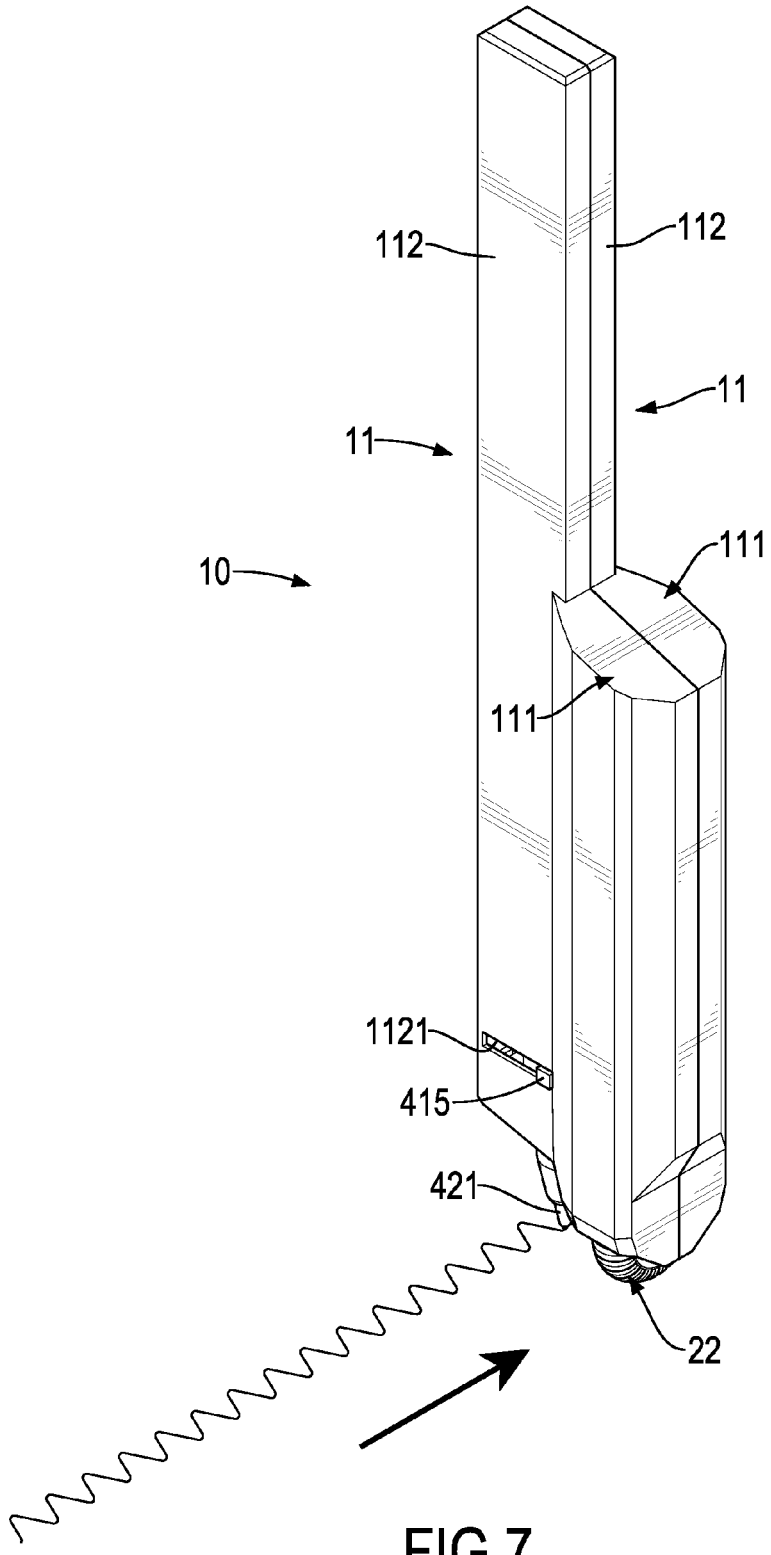
FIG. 7 is an operational perspective view of the pen track in FIG. 1.

In use, with reference to FIGS. 5, 6 and 7, in the first embodiment of the pen track, when the drawing segment 421 is moved on a drawing surface, the rotating wheel 22 is rotated on the drawing surface with the movement of the drawing segment 421. Because the fixing block 212 of the transmitting element 21 is securely mounted in the fixing hole 221 of the rotating wheel 22, the transmitting element 21 is rotated with the rotating wheel 22. Then, the linking element 23 is rotated with the transmitting element 21 by the engagement between the bevel gears 211, 231 of the transmitting element 21 and the linking element 23. When the bevel gear 231 of the linking element 23 is rotated with the bevel gear 211 of the linking element 21, the bevel gear 311 of the rotating element 31 is rotated with the bevel gear 231 of the linking element 23.

Since the embedded protrusion 323 of the modeling block 32 engages the embedded groove 3121 of the rotating element 31, the modeling block 32 is rotated with the rotating element 31. During the rotating process of the modeling block 32, the modeling segment 321 of the modeling block 32 is rotated and is continuously pushed against the pushing protrusion 413 of the holding mount 41. Then, the holding mount 41 is moved in the guiding groove of the outer shell 10 between the guiding ribs 1122 by the sliding blocks 415 moving along the guiding holes 1121 of the second mounting segments 112. In addition, the spring 44 is continuously compressed and reset when the holding mount 41 is moved relative to the second mounting segments 112 by the modeling block 32. With the pushing of the modeling block 32 and the spring 44, the holding mount 41 is reciprocally moved relative to the outer shell 10. Then, the refill 42 is moved with the holding mount 41, and the drawing segment 421 is moved relative to the drawing surface to draw undulating lines on the drawing surface.

Furthermore, the transmission between the transmitting element 21, the linking element 23, and the rotating element 31 can be chain drive, belt drive, gear or other types, or the rotating element 31 is directly rotated by the transmitting element 21. The transmission between the transmitting element 21, the linking element 23, and the rotating element 31 is not limited in the present invention, as long as the rotating element 31 is rotated with the rotating wheel 22 to rotate the modeling block 32.

When a user wants to replace the modeling block 32, the user can separate the half-casings 11 and hold the sliding blocks 415 to move away the transmitting group 20 to enable the pushing protrusion 413 to disengage from the modeling segment 321 of the modeling block 32. Then, the modeling block 32 can be separated from the mounting rod 312 of the rotating element 31 to for replacement with a new modeling block by departing the holding cap 33 from the mounting rod 312.

According to the above-mentioned features and structural relationships of the two embodiments of the pen track, the pen track has the following advantages.

1. The rotating wheel 214, 22 can be rotated relative to the outer shell 10 on a drawing surface to drive the modeling block 32 to rotate, and the refill 42 can be moved relative to the outer shell 10 with the curved surfaces of the modeling segment 321 to enable the drawing segment 421 to draw undulating lines regularly on the drawing surface without using an auxiliary tool such as a french curve or a curve plate, and this can save time and eliminate inconvenience of preparing the auxiliary tool.

2. When using the pen track in accordance with the present invention, the user only needs to hold and move the outer shell 10 on the drawing surface, and the undulating lines can be regularly drawn on the drawing surface easily by the drawing segment 421 of the refill 42. The user does not need to worry about drawing erroneously when the auxiliary tool is slid.

3. The undulating lines can be continuously drawn on the drawing surface by the transmission between the transmitting group 20, the rotating group 30, and the linking group 40, and the lengths of the undulating lines are not limited by the length of the auxiliary tool and can be extended according to the user's need.

4. The user can draw undulating lines of different types on the drawing surface by replacing modeling blocks of different contours without buying and preparing multiple auxiliary tools of different contours, and this can reduce the time and cost of drawing undulating lines on the drawing surface.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pen track comprising:

an outer shell;

a transmitting group mounted in the outer shell and having a portion for rotatably abutting a drawing surface;

a rotating group mounted in the outer shell and having a modeling block mounted in the outer shell, rotated with the transmitting group, and having an outer surface; and a modeling segment annularly formed on the outer surface of the modeling block and having multiple curved surfaces connecting each other; and a linking group mounted in the outer shell and having a pushing protrusion pressed against the modeling segment of the modeling block to move the linking group reciprocally relative to the outer shell along the curved surfaces of the modeling segment, and a refill mounted in and extending out of the outer shell and moved with the pushing protrusion for drawing lines having a contour corresponding to a contour of the curved surfaces of the modeling segment on the drawing surface.

2. The pen track as claimed in claim 1, wherein the outer shell is detachable and has a driving space, and the driving space has an end formed through the outer shell;

the transmitting group is mounted in the driving space of the outer shell and has a transmitting element having a gear rotatably mounted in the driving space; and a rotating wheel formed with the gear and extending out of the outer shell via the end of the driving space to rotatably abut the drawing surface;

a linking element rotatably mounted in the driving space and having a gear engaging with the gear of the transmitting element; and the rotating group is mounted in the driving space of the outer shell and has a rotating element rotatably mounted in the driving space and having a gear engaging with the gear of the linking element.

3. The pen track as claimed in claim 2, wherein the modeling block is replaceable.

4. The pen track as claimed in claim 3, wherein the gear of the rotating element has a mounting rod formed on the gear of the rotating element opposite to the rotating wheel, and the modeling block has a through hole formed through the modeling block and disposed around the mounting rod of the rotating element.

5. The pen track as claimed in claim 4, wherein the mounting rod of the rotating element has a mounting end;

an outer surface; and an embedded groove axially formed through the mounting end and the outer surface of the mounting rod;

the modeling block has an embedded protrusion formed on and inwardly protruding from an inner surface of the through hole to be securely mounted in the embedded groove to rotate the modeling block with the rotating element.

6. The pen track as claimed in claim 5, wherein the outer shell has a pen chamber communicating with the driving space, and the pen chamber has a guiding groove and an end formed through the outer shell;

the linking group is mounted in the pen chamber of the outer shell and has a holding mount movably mounted in the guiding groove of the pen chamber and having a refill hole formed through the holding mount; and a spring mounted in the outer shell and abutting the outer shell and the holding mount;

wherein the refill is mounted through the refill hole of the holding mount and extends out of the outer shell via the end of the pen chamber; and the pushing protrusion is mounted on a side of the holding mount to press against the modeling segment to enable the holding mount to move with the modeling segment of the modeling block.

7. The pen track as claimed in claim 6, wherein the holding mount has a connecting segment formed on an end of the holding mount, communicating with the through hole, and having an external surface and a thread formed around the external surface of the connecting segment; and the linking group has a protecting sheath being hollow, connected to the connecting segment of the holding mount, and having an inner thread formed in the protecting sheath and screwed with the thread of the connecting segment.

8. The pen track as claimed in claim 7, wherein the modeling segment of the modeling block has a cross section being a hexagram.

9. The pen track as claimed in claim 8, wherein the outer shell is composed by two half-casings, and each one of the half-casings has a first mounting segment and a second mounting segment;

each second mounting segment has a guiding hole being elongated and formed through the second mounting segment; and the holding mount has two sliding blocks respectively formed on and protruding from two sides of the holding mount opposite to the pushing protrusion and the spring and respectively and movably mounted in the guiding holes of the second mounting segments.

10. The pen track as claimed in claim 1, wherein the outer shell is detachable and has a driving space, and the driving space has an end formed through the outer shell;

the transmitting group is mounted in the driving space of the outer shell and has a transmitting element having a gear rotatably mounted in the driving space and having an inner side; and a fixing block formed on and protruding from the inner side of the gear of the transmitting element;

a rotating wheel connected to the transmitting element, extending out of the outer shell via the end of the driving space to rotatably abut the drawing surface, and having a fixing hole formed through the rotating wheel and securely disposed around the fixing block to rotate the transmitting element with the rotating wheel; and a linking element rotatably mounted in the driving space and having a gear engaging with the gear of the transmitting element; and the rotating group is mounted in the driving space of the outer shell and has a rotating element rotatably mounted in the driving space and having a gear engaging with the gear of the linking element.

11. The pen track as claimed in claim 10, wherein the modeling block is replaceable.

12. The pen track as claimed in claim 11, wherein the gear of the rotating element has a mounting rod formed on the gear of the rotating element opposite to the rotating wheel, and the modeling block has a through hole formed through the modeling block and disposed around the mounting rod of the rotating element.

13. The pen track as claimed in claim 12, wherein the mounting rod of the rotating element has a mounting end;

an outer surface; and an embedded groove axially formed through the mounting end and the outer surface of the mounting rod;

the modeling block has an embedded protrusion formed on and inwardly protruding from an inner surface of the through hole to securely mount in the embedded groove to rotate the modeling block with the rotating element.

14. The pen track as claimed in claim 13, wherein the outer shell has a pen chamber communicating with the driving space, and the pen chamber has a guiding groove and an end formed through the outer shell;

the linking group is mounted in the pen chamber of the outer shell and has a holding mount movably mounted in the guiding groove of the pen chamber and having a refill hole formed through the holding mount; and a spring mounted in the outer shell and abutting the outer shell and the holding mount;

wherein the refill is mounted through the refill hole of the holding mount and extends out of the outer shell via the end of the pen chamber; and the pushing protrusion is mounted on a side of the holding mount to press against the modeling segment to enable the holding mount to move with the modeling segment of the modeling block.

15. The pen track as claimed in claim 14, wherein the holding mount has a connecting segment formed on an end of the holding mount, communicating with the through hole, and having an external surface and a thread formed around the external surface of the connecting segment; and the linking group has a protecting sheath being hollow, connected to the connecting segment of the holding mount, and having an inner thread formed in the protecting sheath and screwed with the thread of the connecting segment.

16. The pen track as claimed in claim 15, wherein the modeling segment of the modeling block has a cross section being a hexagram.

17. The pen track as claimed in claim 16, wherein the outer shell is composed by two half-casings, and each one of the half-casings has a first mounting segment and a second mounting segment;

each second mounting segment has a guiding hole being elongated and formed through the second mounting segment; and the holding mount has two sliding blocks respectively formed on and protruding from two sides of the holding mount opposite to the pushing protrusion and the spring and respectively and movably mounted in the guiding holes of the second mounting segments.

* * * * *